US005517842A

United States Patent [19]

Ginzburg

[11] Patent Number: 5,517,842

[45] Date of Patent: May 21, 1996

[54] ROLL AND STRIP COOLING SYSTEM FOR ROLLING MILLS

[75] Inventor: Vladimir B. Ginzburg, Pittsburgh, Pa.

[73] Assignees: Danieli United, Inc.; International Rolling Mill Consultants, Inc., both of Pittsburgh, Pa.

[21] Appl. No.: 284,124

[22] Filed: Aug. 2, 1994

[51] Int. Cl.[6] ..... B21B 37/74

[52] U.S. Cl. ..... 72/8.5; 72/201; 72/10

[58] Field of Search ..... 72/201, 10, 13

[56] References Cited

U.S. PATENT DOCUMENTS

| | | | |
|---|---|---|---|
| 3,200,629 | 8/1965 | James et al. | 72/201 |
| 3,881,336 | 5/1975 | Cofer et al. | 72/201 |
| 3,913,369 | 10/1975 | Field et al. | 72/201 |
| 4,247,047 | 1/1981 | Schaming | 239/391 |
| 4,272,976 | 6/1981 | Pizzedaz | 72/201 |
| 4,400,961 | 8/1983 | Schaming | 72/201 |
| 4,403,492 | 9/1983 | Hope | 72/201 |
| 4,577,482 | 3/1986 | Greenberger | 72/201 |
| 4,691,549 | 9/1987 | Adair | 72/38 |
| 5,235,840 | 8/1993 | Blazevic | 72/201 |

*Primary Examiner*—Daniel C. Crane
*Assistant Examiner*—Ed Tolan
*Attorney, Agent, or Firm*—Armstrong, Westerman, Hattori, McLeland & Naughton

[57] ABSTRACT

An apparatus for cooling an upper work roll of a rolling mill stand and a strip of metal being rolled has a header to supply a coolant fluid to the work roll and a stripper with a wiper blade that contacts the surface of the work roll between the header and the strip of metal. A fluid cylinder and extension rod cooperate with the stripper to displace the wiper from contact with the upper roll surface and form a gap through which a portion of the coolant fluid flows to contact and cool the strip of metal. A microprocessor and assorted equipment are used to adjust the size of the gap and effect a desired flow of the portion of coolant fluid on to the surface of the strip of metal.

8 Claims, 2 Drawing Sheets

ROLL AND STRIP COOLING SYSTEM FOR ROLLING MILLS

FIELD OF THE INVENTION

The present invention relates to a system for applying a coolant fluid to the work rolls of a rolling mill stand and, at the same time, to a hot strip of metal that is to be rolled in the rolling mill stand.

BACKGROUND OF THE INVENTION

In hot strip mills, hot, relatively thick slabs or strips of steel are rolled into thin strips by passage between work rolls of one or more rolling mill stands. During a metal rolling operation, mill rolls are continuously heated by a work heat due to the plastic deformation of the rolled metal, a frictional heat generated between the rolled metal and the rolls, and, in case of hot rolling, heat transfer from a hot metal workpiece. Particularly in the case of hot rolling steel where the steel to be rolled is preheated to temperatures in excess of 1200° C., roll heating as a result of heat transfer can become rather excessive.

Because of such roll heating, it is imperative that means be provided to cool the rolls during use and thereby prevent unwanted thermal expansion of the rolls, which can adversely affect the quality of the rolled product. For example, some rolls tend to become excessively heated in their mid-portion, causing the diameter to increase only in the mid-portion, and therefore roll a thinned mid-section into the product as compared to the outer sections. In addition, excessively heated rolls will wear more quickly and tend to stick to the rolled metal surface to adversely affect the surface quality of the rolled product.

Also, during the hot strip mill rolling operation the strip of metal being rolled must be cooled so as to achieve a predetermined microstructure and thus the desired physical properties in the hot rolled product before the slab or strip of metal reaches the rolling stand. Generally, for steel, the cooling rate should be fast enough to achieve the transformation to a desired ferrite microstructure but not so fast as to quench the steel to a condition resulting in brittleness.

Numerous types of cooling apparatus have been proposed, with normally one device used for cooling of the work rolls, while a second device is used for cooling of the hot metal strip.

A conventional cooling system for work rolls and a metal strip being rolled is illustrated in FIG. 1. As illustrated, work rolls 1 and 2 are provided through which a hot strip of metal 3 is passed, the work rolls 1 and 2 provided with respective back-up rolls 4 and 5. The hot strip of metal 3 is moved to and through the work rolls 1 and 2 by the use of table rolls 6, 7 and 8, with aprons 9 and 10 also provided. The lower work roll 2 is cooled by application of a coolant fluid 11, such as water, onto the work roll 2 through a lower coolant fluid supply header 12. An upper coolant fluid supply header 13 is also provided to direct a supply of a coolant fluid 14 onto the upper work roll 1. A wiper or stripper 15 is positioned between the upper coolant fluid supply header 13 and the strip of metal 3, which has a wiper blade 16 that contacts the surface 17 of upper work roll 1 and directs excess coolant fluid 14 off to the sides of the strip of metal 3 and prevents contact of the fluid coolant 14 with the upper surface 18 of the strip of metal 3. The stripper 15 is arranged to contact the upper work roll 1 by support on a stripper guide 19, with a stripper retracting fluid cylinder 20 provided which, through rod 21 and connection 22, is adapted to provide a wiping contact of the wiper blade 16 of stripper 15 against surface 17 of the upper work roll 1, the fluid cylinder being supported by a support frame 23. In order to cool the strip of metal 3, a strip cooling header 24 is disposed above and across the strip of metal and a coolant fluid 25 is directed from the strip coolant header 24 onto the upper surface 18 of the hot strip of metal 3.

While such a roll and strip coolant system is conventionally used, there are disadvantages associated with such a system. One disadvantage lies in the need for two coolant fluid manifolds and delivery systems, one for the work roll 1 and another for the strip of metal 3. Another disadvantage exists in that the coolant fluid contact with the strip of metal is made at location distant from the bite of the work rolls 1 and 2, such that there is enough time for the surface 18 of the strip of metal 3 to rebound in temperature because of the heat transfer from the inner portions of the strip of metal. Such rebound in temperature of the surface 18 of the strip of metal 3 results in increased rescaling of the strip surface 18 and subsequently increased scale pickup by the work roll 1.

OBJECTS OF THE INVENTION

It is an object of the present invention to provide a roll and strip coolant system that is a combined unit rather than separate units.

It is another object of the present invention to provide a strip cooling system that is located at a position closely adjacent the roll bite of the work rolls rather than at a distant location.

It is a further object of the present invention to provide a roll and strip coolant system having an ability to regulate the flow of coolant fluid to the strip of hot metal to be cooled.

SUMMARY OF THE INVENTION

The cooling apparatus of the present invention is for cooling of an upper work roll of a rolling mill stand as well as a strip of metal being rolled in the mill stand. The rolling mill stand has upper and lower work rolls through which a strip of metal is passed to reduce the thickness thereof, and a cooling device for cooling the lower work roll. A header is provided to apply a cooling fluid to the surface of the upper work roll at a location above a stripper that has a wiper for contacting the surface of the upper work roll. A displaceable extension rod of a fluid cylinder is connected to the stripper and the wiper of the stripper is variably displaced by movement of the extension rod to form a gap between the wiper and the surface of the upper work roll and to direct at least a portion of the cooling fluid on to the strip of metal to cool the strip of metal immediately prior to entry between the work rolls.

The present method provides for cooling of an upper work roll of a rolling mill stand and a strip of metal being rolled, where a stripper is provided with a wiper to control the surface of the upper work roll, by applying a coolant fluid onto the surface of the upper work roll above the wiper and displacing the wiper from a position in contact with the surface of the work roll to a controlled distance from the surface so as to form a gap between the wiper and the surface and direct at least a portion of the coolant fluid onto the strip of metal passing between the upper work roll and a lower work roll of the rolling mill stand.

BRIEF DESCRIPTION OF THE DRAWINGS

The invention will be more readily understood by reference to the accompanying drawings of a preferred embodiment of the present apparatus and method, wherein.

DETAILED DESCRIPTION

The present apparatus and method provide for cooling of an upper work roll of a rolling mill stand and controlled cooling of a strip of metal being rolled.

Figure 1:
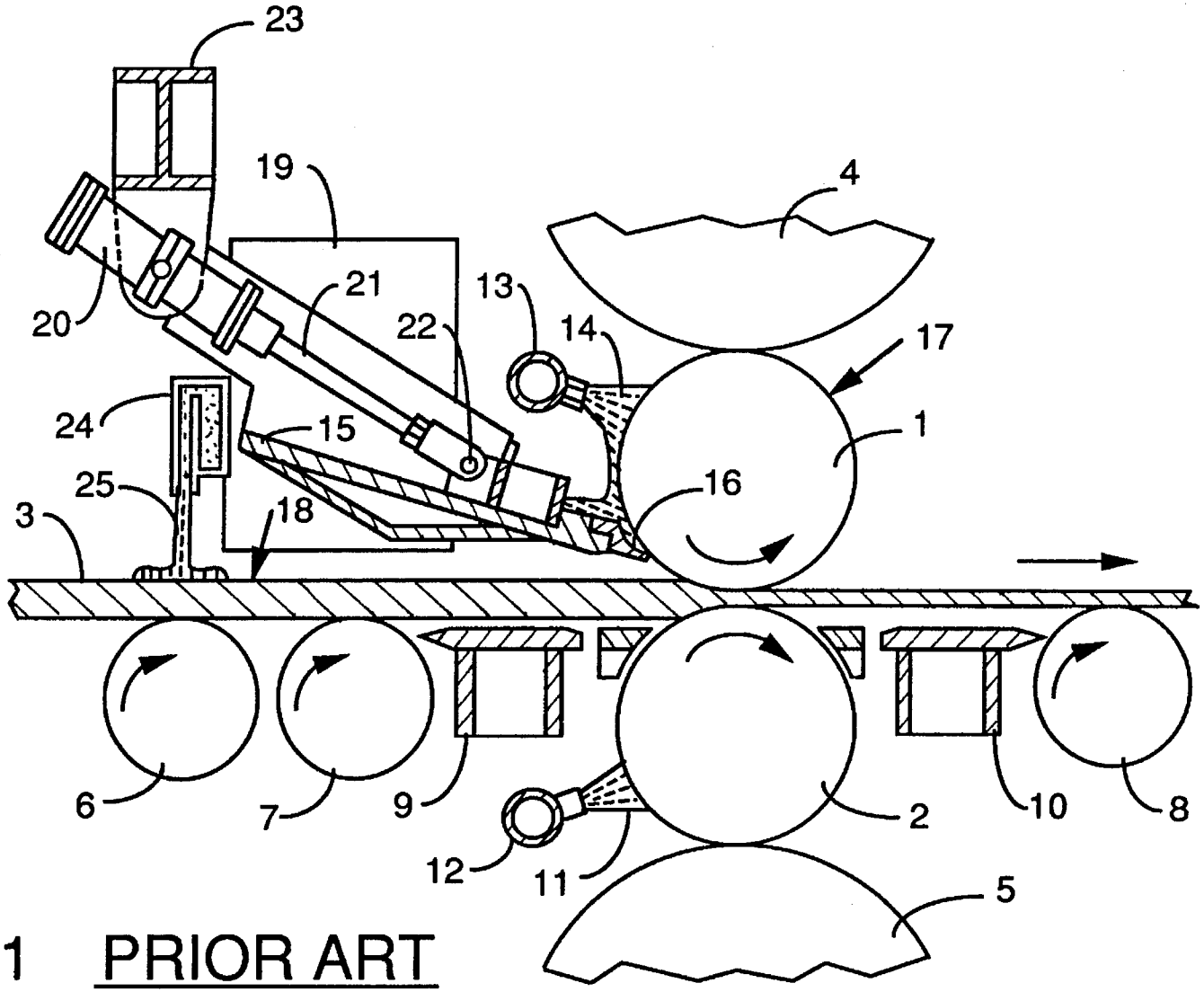
FIG. 1 PRIOR ART
FIG. 1 is a vertical cross-sectional view of a prior art apparatus for cooling an upper work roll and a strip of metal being rolled.
Figure 2:
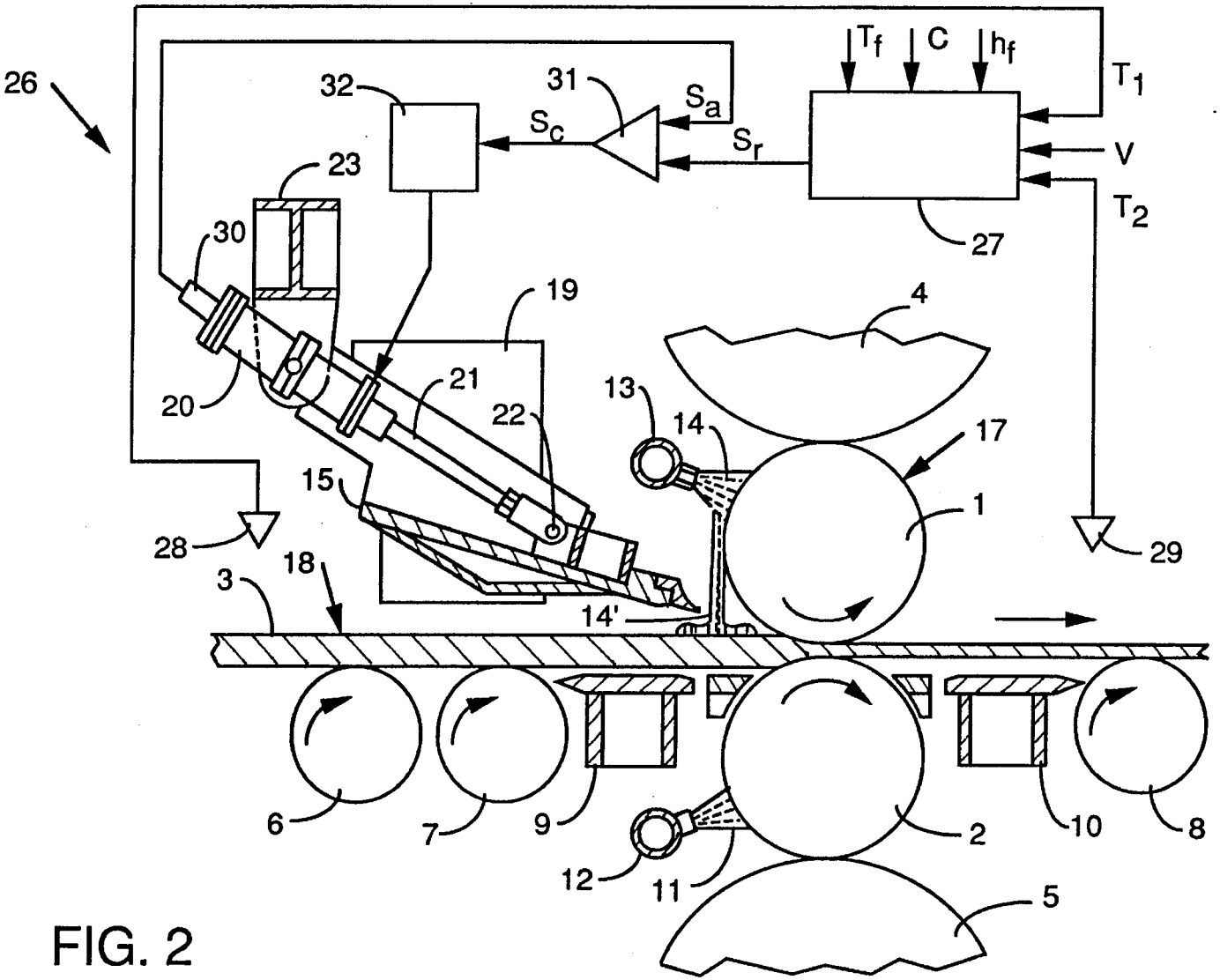
FIG. 2 is a vertical cross-sectional view similar to FIG. 1 showing the apparatus of the present invention.

The present apparatus 26 for cooling the upper work roll and a hot metal strip during a rolling operation is illustrated in FIG. 2. The components in FIG. 2 which are common to those of the prior art cooling system of FIG. 1 are labeled with the same numbers. In the embodiment of FIG. 2, the wiper or stripper 15 with wiper blade 16 is carried by guide 19 and connected to retracting fluid cylinder 20 through rod 21 and connection 22. The position of stripper 15 and wiper blade 16 is regulated during cooling so as to provide a flow of at least a portion of the coolant fluid 14, designated as 14' between the wiper blade 16 and the work roll 1 and onto the upper surface 18 of the hot strip of metal 3 adjacent the bite between work rolls 1 and 2. The rate of flow of the coolant fluid 14' onto the upper surface 18 of the strip of metal 3 is regulated by opening or closing the gap between the surface 17 of the work roll 1 and the wiper 16 of the stripper 15, the regulation effected by varying the extension of the rod 21 from the fluid cylinder 20.

The degree of extension of rod 21 from the fluid cylinder 20 is controlled by a microprocessor 27. Means to measure the entry temperature $T_1$, prior to entry of the strip of metal 3 between work rolls 1 and 2, such as a first pyrometer 28, and means to measure the exit temperature $T_2$, after exit of the strip of metal 3 from between work rolls 1 and 2, such as a second pyrometer 29 are provided. The degree of extension of the rod 21 from the cylinder 20, and thus the width of the gap between the wiper 16 and the surface 17 of the work roll 1, is controlled by microprocessor 27, based on entry and exit temperatures $T_1$ and $T_2$ of said strip of metal, strip finish temperature $T_f$, finish gauge $h_f$ of said strip of metal, mill speed V, and strip chemical composition C of said strip of metal. The calculated reference for the rod 21 extension $S_r$ is compared with the measured rod 21 extension signal $S_a$ produced by a transducer 30. The comparison is made by position regulator 31 that generates a signal $S_c$ to a servovalve 32 which regulates the fluid flow into or out of the fluid cylinder 20 to obtain the desired gap between the surface 17 of work roll 1 and the wiper 16 of the stripper 15.

As is thus shown, according to the present method, a coolant is applied onto the surface of a work roll above a wiper blade of a stripper and the stripper and wiper blade are displaced from a position where it is in contact with the surface of the work roll to a controlled distance from the surface. The gap formed between the surface of the work roll and the wiper can be adjusted so as to direct a desired portion of the coolant fluid onto the surface of the strip of metal being rolled. The displacement of the wiper is controlled by a microprocessor based upon the factors hereinbefore described.

The present system provides for cooling of a work roll and a strip of metal using a common source of coolant fluid and effects cooling of the strip of metal immediately adjacent the roll bite of the work rolls that are used to roll the strip of metal. The position of the stripper is regulated to provide a desired flow of coolant fluid on to the surface of the strip of metal.

What is claimed is:

1. In a rolling mill stand having upper and lower work rolls and having a roll bite through which a strip of metal is passed to reduce the thickness of said strip, with means to cool said lower work roll and a stripper having a wiper arranged to contact the surface of upper work roll across the width thereof, the improvement comprising means for cooling said upper work roll and said strip of metal, prior to entry of the strip of metal between said work rolls, including means for applying a coolant fluid to said upper work roll at a location above said stripper, and means for regulatable variable displacement of the wiper of said stripper away from contact with said roll based upon a sensed condition of the strip of metal so as to direct at least a portion of said coolant onto said strip of metal immediately adjacent said roll bite to cool said strip of metal prior to entry between said work rolls.

2. The improvement as defined in claim 1 wherein said means for variable displacement of said stripper comprises an extension rod connected to said stripper and a fluid cylinder for extension and retraction of said extension rod.

3. The improvement as defined in claim 2, including means for measuring the entry temperature of said strip of metal prior to entry between said work rolls, means to measuring the exit temperature of said strip of metal upon exit from between said work rolls, and means for controlling the degree of extension or retraction of said extension rod from said fluid cylinder.

4. The improvement as defined in claim 3, wherein said means for controlling the degree of extension or retraction of said extension rod comprises a microprocessor adapted to control said extension or retraction based upon entry and exit temperatures of said strip, strip finish temperature, finish gauge of said strip of metal, mill speed, and strip chemical composition of said strip of metal.

5. A method of cooling an upper work roll of a rolling mill stand, having upper and lower work rolls and having a roll bite and a strip of metal being rolled in the rolling mill stand, the rolling mill stand having a stripper with a wiper arranged to contact the surface of said upper work roll at a location above said strip of metal, comprising; applying a coolant fluid onto the surface of said work roll above said wiper and regulatably displacing said wiper from a position in contact with the surface of said upper work roll based upon a sensed condition of the strip of metal to a controlled distance from said surface to form a gap therebetween and so as to direct at least a portion of said coolant fluid onto said strip of metal immediately adjacent said roll bite.

6. The method as defined in claim 5 wherein displacing of said wiper to form said gap is controlled by a microprocessor based upon entry and exit temperatures of said strip of metal from the rolling mill stand, strip finish temperature, finish gauge of said strip of metal, mill speed, and chemical composition of said strip of metal.

7. In a rolling mill stand having upper and lower work rolls through which a strip of metal is passed to reduce the thickness of said strip, with means to cool said lower work roll and a stripper having a wiper arranged to contact the surface of upper work roll across the width thereof, the improvement comprising means for cooling said upper work roll and said strip of metal, prior to entry of the strip of metal between said work rolls, including means for applying a coolant fluid to said upper work roll at a location above said stripper, means for variable displacement of the wiper of said stripper away from contact with said roll so as to direct at least a portion of said coolant onto said strip of metal to cool said strip of metal prior to entry between said work rolls, and means to compare a desired extension or retraction of said extension rod with an actual position signal generated by a position regulator and to generate a signal to a servovalve which regulates fluid flow into or out of said fluid cylinder.

8. A method of cooling an upper work roll of a rolling mill stand and a strip of metal being rolled in the rolling mill stand, the rolling mill stand having a stripper with a wiper arranged to contact the surface of said upper work roll at a location above said strip of metal, comprising; applying a coolant fluid onto the surface of said work roll above said wiper and displacing said wiper from a position in contact with the surface of said upper work roll to a controlled distance from said surface to form a gap therebetween and so as to direct at least a portion of said coolant fluid onto said strip of metal, and wherein a calculated reference of said displacing to form said gap is compared with actual said displacing and a comparison made between said calculated and actual displacing and a signal generated which regulates said displacing to obtain a desired said gap.

* * * * *